US005292078A

United States Patent [19]

Lodovico et al.

[11] Patent Number: 5,292,078

[45] Date of Patent: * Mar. 8, 1994

[54] MACHINE FOR CUTTING MATERIAL

[75] Inventors: Frank J. Lodovico, Delmont; John W. Wagner, New Alexandria, both of Pa.

[73] Assignee: Allegheny Paper Shredders, Inc., Delmont, Pa.

[ * ] Notice: The portion of the term of this patent subsequent to Jan. 12, 2010 has been disclaimed.

[21] Appl. No.: 961,876

[22] Filed: Oct. 16, 1992

Related U.S. Application Data

[63] Continuation-in-part of Ser. No. 775,159, Oct. 11, 1991, Pat. No. 5,178,336.

[51] Int. Cl.[5] ..... B02C 18/16

[52] U.S. Cl. ..... 241/167; 241/236

[58] Field of Search ..... 241/99, 166, 167, 236; 83/113, 114, 121

[56] References Cited

U.S. PATENT DOCUMENTS

| | | | |
|---|---|---|---|
| 2,770,302 | 11/1956 | Lee | 83/114 |
| 3,033,064 | 5/1962 | Lee | 83/114 |
| 4,565,330 | 1/1986 | Katoh | 241/236 |
| 4,693,428 | 9/1987 | Raterman et al. | 241/167 |
| 4,729,515 | 3/1988 | Wagner | 291/99 |
| 4,750,678 | 6/1988 | Lodovico et al. | 241/29 |
| 5,074,479 | 12/1991 | Lamar | 241/101.7 |
| 5,110,060 | 5/1992 | Lundquist | 241/158 |
| 5,178,336 | 1/1993 | Lodovico et al. | 241/99 |

*Primary Examiner*—Mark Rosenbaum
*Assistant Examiner*—John M. Husar
*Attorney, Agent, or Firm*—James L. Sherman

[57] ABSTRACT

An improved machine for cutting material into at least narrow strips includes parallel, rotating cutting shafts having a plurality of cutting wheels thereon. The cutting wheels are separated by spacer-comber elements which provide a comber surface in alignment with a cutting wheel on the other shaft. A cutting wheel comber is mounted between adjacent spacer-comber elements and includes a concave surface to partially encircle the cutting wheel therebetween. The cutting wheel comber has a discharge end toward the discharge side of the machine with a rounded portion. The regions along the concave surface is separated by different distances from the cutting wheel to prevent the retention and collections of the narrow strips of material at the backsides of the cutting wheels.

11 Claims, 3 Drawing Sheets

MACHINE FOR CUTTING MATERIAL

CROSS-REFERENCE TO RELATED APPLICATION

This application is a continuation-in-part application of co-pending U.S. application Ser. No. 07/775,159, now U.S. Pat. No. 5,178,336 entitled "MACHINE FOR CUTTING DISPOSABLE CONTAINERS" and filed on Oct. 11, 1991, by the same inventor and on behalf of the same assignee of this application.

BACKGROUND OF THE INVENTION

1. Field of Invention

This invention relates to a machine which is capable of cutting any one of numerous sizes of disposable containers such as plastic bottles and/or metal cans into small pieces and to such a machine which is configured to insure that the small pieces are directed below the cutting area of the machine for collection and disposition. A similar configuration is employed on an improved machine which is capable of cutting paper material into strips of paper to insure that the strips do not collect in a region behind the cutting wheels.

2. Description of the Prior Art

U.S. Pat. No. 4,923,126, which is incorporated by reference in its entirety herein, discloses a machine which is capable of cutting into small pieces the thin wall material of a plurality of disposable containers such as plastic bottles and metal cans. The cutting section of the machine includes a pair of parallel shafts mounted for rotation in opposite directions about the center axes thereof. Each of the shafts rigidly supports a plurality of overlapping cutting wheels for rotation therewith. Each cutting wheel has a plurality of identical cutting teeth with each tooth having an apex at the maximum diameter and a root at a root diameter of the cutting wheel. Each cutting tooth has a leading surface and a trailing surface which meet at the apex to form a straight edge at the maximum diameter which is parallel to the center axis of the shaft. The leading surface and the trailing surface respectively lie in planes which are parallel with the center axis of the shaft and extend toward the same side thereof to cause the straight edge of the apex to circumfrentially lead a remainder of the leading surface during rotation of the cutting wheel.

The basic cutting wheel configuration has been found to effectively and reliably produce the small pieces of the containers as disclosed therein. Generally, the embodiment in U.S. Pat. No. 4,923,126 is configured to cause most of the small pieces to be ejected downwardly from the cutting area between the cutting wheels. A dispersing section below the cutting area is intended to disperse the small pieces throughout a collecting section therebelow. The small pieces are received within a container in the collecting section and eventually removed for further disposition. However, it has been found that suctioning or vacuuming means disposed in the lower area of the machine is preferred in order to transport the small pieces to a larger container remote from the machine itself. In either case, it is clearly desirable that all of the small pieces produced in the cutting section be discharged from the cutting area and to be prevented from collecting around the cutting wheels or the cutting shafts.

As further discussed in U.S. Pat. No. 4,923,126, such machines are typically utilized for the cutting of disposable containers employed in the soft drink industry. As a result, there have been continuing problems with the cutting of such disposable containers which have not typically existed in the operation of other types of cutting machines found in the prior art. The soft drink liquid remaining in the disposable containers has been found, in a short time of operation, to completely engulf the interior of the container cutting machine. The liquid is extremely corrosive and the sugary substance can cause even greater problems when heated. The friction created by the rotating cutting wheels can produce a build up of solid, corrosive by-products that can seriously reduce the effectiveness and even the life of the machine. Additionally, because the soft drink liquid is deposited on many of the small pieces produced by the cutting machine, the small pieces also become sticky and tend to collect in the area of the cutting wheels to present significant problems with continued and effective operation of the machine. As a result, it is desirable for the cutting section to be configured to prevent the collection of such corrosive and destructive pieces therein.

In order to determine an effective way for preventing the collection of such small pieces in the cutting section of the machine, it is appropriate to analyze the types of combing means which have been employed in other cutting or shredding machines which were not specifically adapted for the cutting and shredding of containers found in the soft drink industry.

One group of such devices disclosed in prior art patents includes some form of combing means located at the backside of the spacer element between the cutting wheels. These spacer combers prevent the collection of pieces or strips of material between the cutting wheels at the backside thereof. Various cutting machines including such combing configurations are disclosed in U.S. Pat. No. 3,931,935; British Patent Nos. 1,558,423 and 2,059,904; German Patentschrift No. 249,359; German Auslegeshrift No. 1,291,606; and German Offenlegungsschrift Nos. 2,526,650; 2,723,281; 3,231,341; and 3,313,231.

All of the devices disclosed in these patents are characterized by the inclusion of some type of separate or integrally formed annular spacer ring between adjacent cutting wheels or discs on one shaft. The annular spacer ring tends to serve as a rotating comber for the aligned cutting wheel or disc on the other shaft. As a result, the pieces or strips of material are maintained in close proximity with the cutting wheel or disc by which they are formed. The spacer ring rotates in the direction of movement through the cutting area to facilitate the formation of the pieces or strips and their passage through the cutting area of the machine.

The devices disclosed therein are also characterized by the inclusion of a fixed "combing" means or "scraping" device which tends to prevent the collection of any material around the rotating spacer ring. The location of the fixed combing means at the lower or rear region of each spacer ring would prevent the collection of the strip or piece material at the backside of the spacer ring remote from the cutting area. However, as will be seen, the general shape and form of such combing means may not be satisfactory for the "combing" or "scraping" of the small pieces formed from soft drink containers because of the soft drink liquid tending to form and collect thereon.

Another group of cutting or shredding machines also includes additional means for preventing the collection of small pieces of material at the remote side of the cutting wheels themselves rather than simply at the remote or backside of the spacer ring. Such cutting or shredding machines are disclosed in U.S. Pat. Nos. 4,068,805 and 4,702,422; French Patent No. 45,173; and Japanese Patent Nos. 55-136597 and 63-232860. All of these machines apparently incorporate a solid comber block or backing member which occupies the space within the housing at the backside of both the rotating cutting wheels and the spacer rings therebetween. U.S. Pat. No. 4,693,428 discloses a particle-type shredding mechanism with a stacked array of spacer and cutting wheel combers. Such configurations will again tend to prevent most of the pieces or strips from being carried about the interior of the machine with the rotating cutting discs and spacers. To a greater or lesser degree, each of these prior art comber configurations will tend to prevent the collection of such pieces or strips in the region remote from the cutting area. However, as will be seen later, the particular configurations of the prior art combing devices aligned with the cutting discs and with the spacer rings do not entirely prevent the undesired collection of the type of small pieces produced by the cutting of plastic bottles and/or metal cans found in the soft drink industry.

While the preferred configuration was particularly adapted for preventing the undesired collection of small pieces produced by the cutting of plastic bottles and/or metal cans found in the soft drink industry, it has also been determined that a similar configuration of cutting wheel combers could be employed in a conventional paper shredding machine to provide an improved machine for cutting such paper material. Although the paper shredding machine includes a different comber-spacer configuration between the cutting wheels, the preferred cutting wheel comber which partially encircles the remote side of the cutting wheels employed in such paper shredders would also advantageously prevent the collection of paper at the remote side of the cutting wheels.

All of the U.S. and foreign patents discussed hereinabove are incorporated by reference as if included in their entirety herein.

SUMMARY OF THE INVENTION

It is therefore an object of the present invention to provide a machine for cutting disposable containers such as plastic bottles and metal cans into small pieces while insuring that the small pieces do not collect in the cutting machine at the backside of the cutting wheels or the spacer rings therebetween.

It is another object to provide such a machine including a combing means which will prevent such undesired collection of small pieces at the backside of the cutting wheels and spacer rings while also preventing any collection on the combing means itself.

It is a further object to provide such a machine which effectively prevents any undesired collection of the small pieces therein and thus improves the reliability and extends the life of the machine.

It is yet another object to provide an improved paper shredding machine which incorporates a similar cutting wheel combing element at the backside of the cutting wheels to prevent the collection and retention of strips of paper material at the backside of the cutting wheels and on the cutting wheel combing element itself.

These and other objects are provided in a preferred embodiment of the invention including an improved machine capable of cutting material into at least narrow strips of the material. The machine is of a type which includes a pair of parallel cutting shafts mounted for rotation about central axes thereof in opposite directions. Each of the cutting shafts supports a plurality of cutting wheels mounted for rotation therewith. Each of the cutting wheels on one of the cutting shafts axially separates and extends between axially adjacent cutting wheels on the other of the cutting shafts. A spacer-comber element is mounted to extend around the cutting shaft between each of the adjacent cutting wheels thereon and to provide a guiding surface aligned with the cutting wheel on the other of the cutting shafts. The cutting wheels are capable of cutting the material into the narrow strips when the material is fed from a feed side of the machine into a cutting area between the cutting shafts for discharge toward a discharge side of the machine. The improvement includes a cutting wheel comber which is fixedly mounted remote from the cutting area and aligned with each of the cutting wheels and disposed between the adjacent spacer-comber elements of the cutting wheel. The cutting wheel comber has a concave surface adjacent to, partially surrounding, and radially spaced from a circular path of the cutting wheel. The concave surface of the cutting wheel comber terminates at a convex rounded portion of the cutting wheel comber at a discharge end of the cutting wheel comber located toward the discharge side of the machine. The convex rounded portion is located toward the discharge side of the central axis and disposed therefrom toward a side which is remote from the cutting area.

The improved machine can include the concave surface which extends along an arcuate portion of the circular path of the cutting wheel from the discharge end toward a feed end which is located toward a feed side of the machine. A radial distance between the arcuate portion and the concave surface varies along the arcuate portion from the discharge end to the feed end of the concave surface. The concave surface has an intermediate region between the discharge end and the feed end which is located toward the feed side of the central axis. The intermediate region is a first predetermined radial distance from the arcuate portion of the circular path of the cutting wheel for restricting passage of the narrow strips therebetween. The discharge end of the concave surface of the cutting wheel comber may be at a second predetermined radial distance from the arcuate portion with the second predetermined radial distance being larger than the first predetermined radial distance. The feed end of the concave surface, located toward the feed side of the machine, may be at a third predetermined radial distance from the arcuate portion with the third predetermined radial distance being larger than the first predetermined radial distance. In the preferred machine, the second predetermined radial distance is at least one and one-half times the first predetermined radial distance and the third predetermined radial distance is at least one and one-tenth times the first predetermined radial distance.

When the material is sheet paper, the improved machine can include the first predetermined radial distance between about 0.35 inch to about 0.50 inch. The second predetermined radial distance may be at least about one and one-half times the first predetermined radial distance.

When the material is the thin walls of disposable containers such as plastic bottles or metal cans, the improved machine can include the first predetermined radial distance between about 0.08 inch and about 0.10 inch. The second predetermined radial distance may be at least about three times the first predetermined radial distance.

The machine can have the concave surface which includes at an intermediate region between the discharge end and the feed end, the intermediate region is a first predetermined radial distance from the arcuate portion of the circular path of the cutting wheel, the feed end of the concave surface at a third predetermined radial distance from the arcuate portion, and the third predetermined radial distance is larger than the first predetermined radial distance.

DETAILED DESCRIPTION OF THE PREFERRED EMBODIMENT

Figure 1:
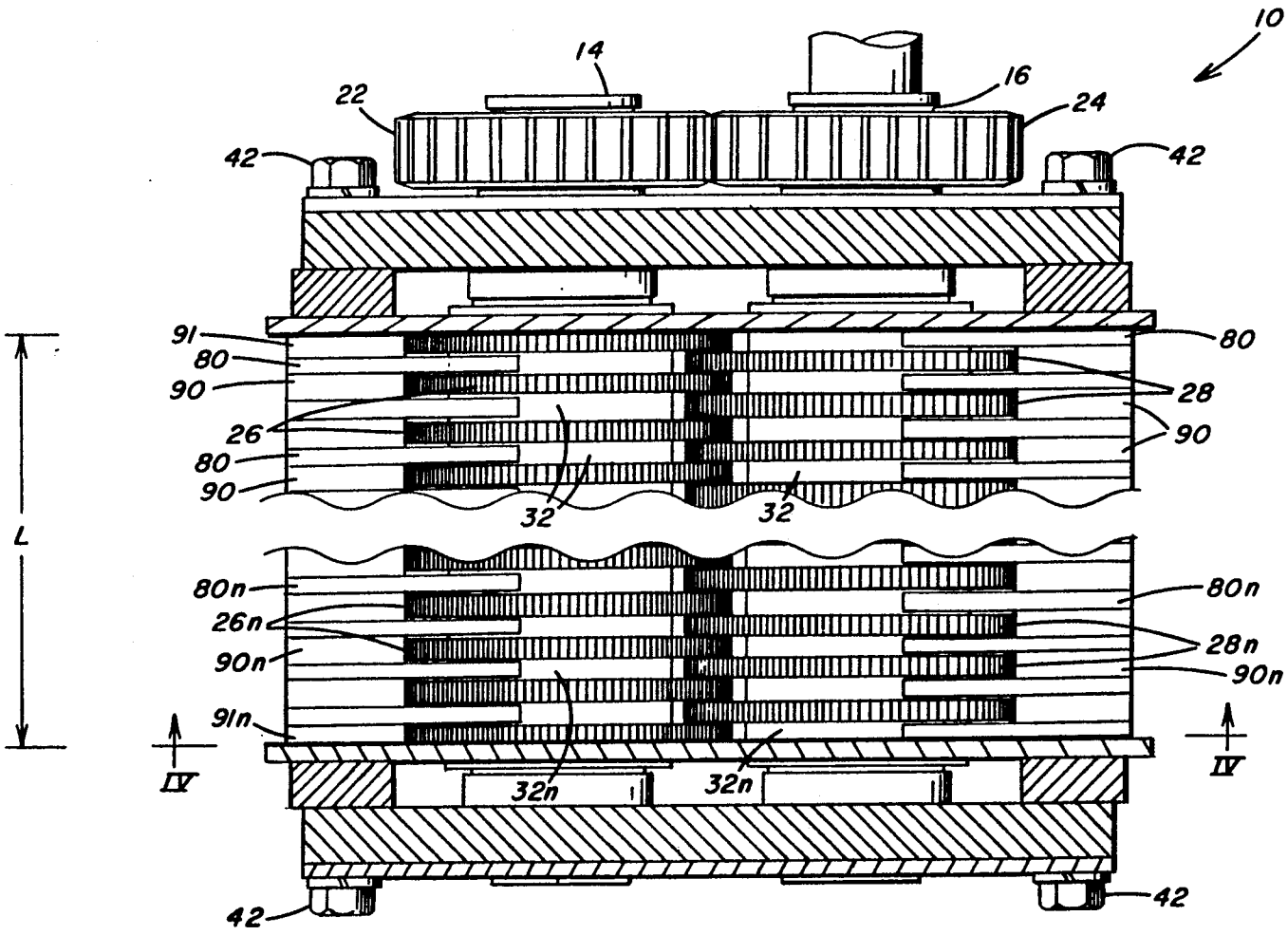
FIG. 1 is a fragmentary, sectional top view of the preferred cutting machine including various features of the invention. The upper portion of FIG. 1 includes components of the cutting machine as initially installed and the lower portion includes the components after the machine is overhauled.
Figure 4:
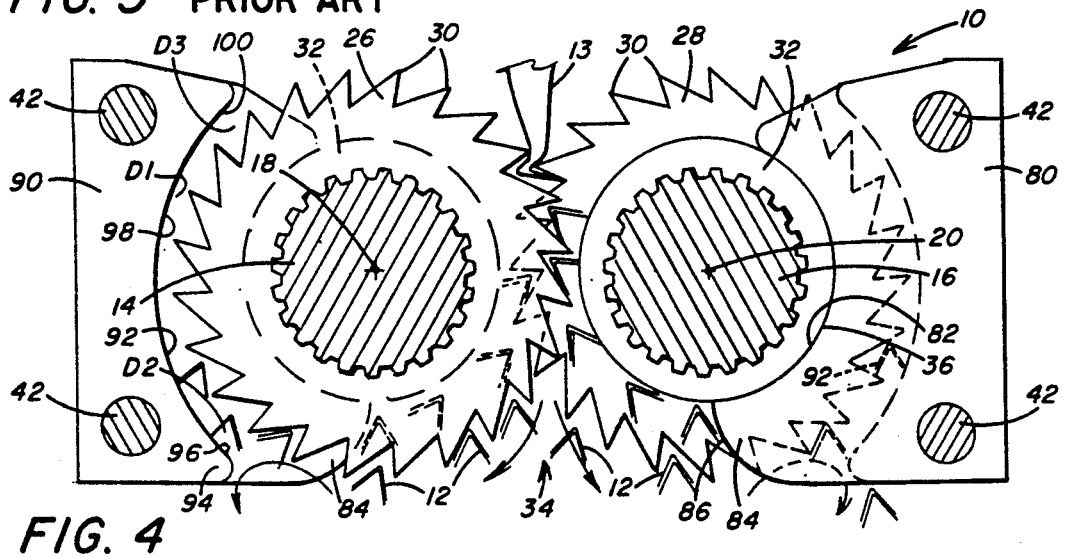
FIG. 4 is a side view of the cutting machine as seen along Line IV—IV of FIG. 1 including various features of the invention.

As seen in FIGS. 1 and 4, a preferred improved cutting machine 10 is capable of cutting into small pieces 12 the thin wall material 13 of a plurality of disposable containers such as plastic bottles or metal cans. The cutting machine 10 includes a pair of parallel cutting shafts 14, 16 mounted for rotation about their central axes 18, 20 in opposite directions. The cutting shaft 16 is coupled to a motor and reduction gear configuration (not shown) to cause rotation in the counter-clockwise direction as seen in FIG. 4. The shaft 16 includes a gear 24 which is engaged with a gear 22 on the shaft 14 in order to produce the opposite rotation of the shafts.

Each shaft 14, 16 includes a plurality of external splines for the receipt of matching internal splines of a center opening of each of a plurality of cutting wheels 26, 28. The cutting wheels 26, 28 are identical and include a plurality of cutting teeth 30 thereon. When each cutting wheel is installed on a shaft, it is indexed with respect to the previously installed cutting wheel. As a result, the teeth 30 are disposed in a helical array to produce more even and effective cutting.

The configuration of cutting wheels 26, 28 with the cutting teeth 30 thereon is identical to the basic configuration disclosed in U.S. Pat. No. 4,923,126, discussed hereinabove. Although the machine disclosed therein included a similar tooth configuration, the machine 10 includes a larger shaft, a larger cutting wheel opening, and spline mounting therebetween. Additionally, a different annular spacer 32 has been employed to maintain the spacing between adjacent cutting wheels 26 on the shaft 14 and between adjacent cutting wheels 28 on the shaft 16. Generally, the shafts in the prior cutting machine of U.S. Pat. No. 4,923,126 were smaller and did not have the large splines as provided in the preferred cutting shafts 14, 16 of the present invention. The cutting wheels of the device disclosed in U.S. Pat. No. 4,923,126 were keyed to the shafts to produce the generally helical array of teeth about the shafts as discussed above. The annular spacers disclosed therein were primarily intended to maintain the axial spacing of the cutting wheels on their respective shafts. Consequently, the general "combing" of the material through the cutting wheels was provided by an array of separately attached and configured combers.

However, in the preferred machine 10 of FIGS. 1 and 4, each shaft 14, 16 includes an array of annular spacers 32 with matching splines and a larger outside diameter to maintain the space between axially adjacent cutting wheels on the respective shafts 14, 16. The larger spacers 32 tend to provide a rotating, combing function in order to facilitate the passage of the thin wall material and the resulting small pieces 12 therethrough. It had been found in the machine of U.S. Pat. No. 4,923,126 that some of the small pieces 12 would begin to collect on the flat lower surfaces of the fixed combers near the cutting area. The preferred rotating annular spacers 32, which provide basic combing in the machine 10, facilitate better movement of the small pieces 12 through the cutting area 34.

In either case, the type of cutting produced by the cutting wheels 26,28 is identical to that basically produced by the machine disclosed in U.S. Pat. No. 4,923,126. The plastic bottles or metal cans are directed between the cutting wheels 26,28 by a feeding paddle configuration (not shown). The cutting wheels 26 are angularly displaced with respect to the cutting wheels 28. Just prior to cutting, the general alignment of each cutting tooth 30 on one of the cutting wheels 26,28 is between the preceding adjacent cutting teeth and the following adjacent cutting teeth on the other cutting wheel 28,26 of the other shaft. Basically, the thin wall material is entrapped between the trailing edges of the preceding cutting teeth and the leading edges of the following cutting teeth as the particular cutting tooth 30 begins to bend the thin wall material of the container. With continued rotation, the apex of the cutting tooth 30 produces a transverse cut while the side edges of the overlapping teeth produce a pair of longitudinal cuts to complete the formation of each of the small pieces 12. This cutting process is fully disclosed in U.S. Pat. No. 4,923,126 which is incorporated by reference herein.

While the machine 10, as described, effectively and reliably produces the plurality of small pieces 12, there still remains a need to prevent the undesired collection and retention of some of the small pieces 12 within the cutting machine 10.

As discussed hereinabove, there is a continuing concern that the corrosive material and/or small pieces of the containers including the corrosive material will collect in the cutting machine 10. The retention of the small pieces 12 or the corrosive material even in areas remote from the actual cutting area 34 between the shafts 14,16, can be detrimental to the effective operation of the machine. The array of combers disclosed in U.S. Pat. No. 4,923,126 have generally been found to successfully prevent the collection of small pieces 12 at the backside of each of the spaces established between the cutting wheels by the spacer rings. However, the formation of the small pieces including the soft drink fluid thereon results in the small pieces tending to collect on the flat, straight surfaces of the fixed combers at the lower region of the cutting area.

With the inclusion of the rotating annular spacers 32, one might assume that such collection of small pieces at the lower region of the cutting area 34 would be eliminated. Clearly, passage through the cutting area 34 is enhanced by the rotating annular spacers 32. On the other hand, some means must be provided for actually "combing" or "stripping" the small pieces from the cylindrical outer surface 36 of the annular spacers 32. With rotating annular spacers generally employed in other types of cutting or shredding machines in the past, one might expect that some type of fixed comber configuration employed in these prior art machines would be adaptable for use in the preferred cutting machine 10 of the present invention.

Figure 2:
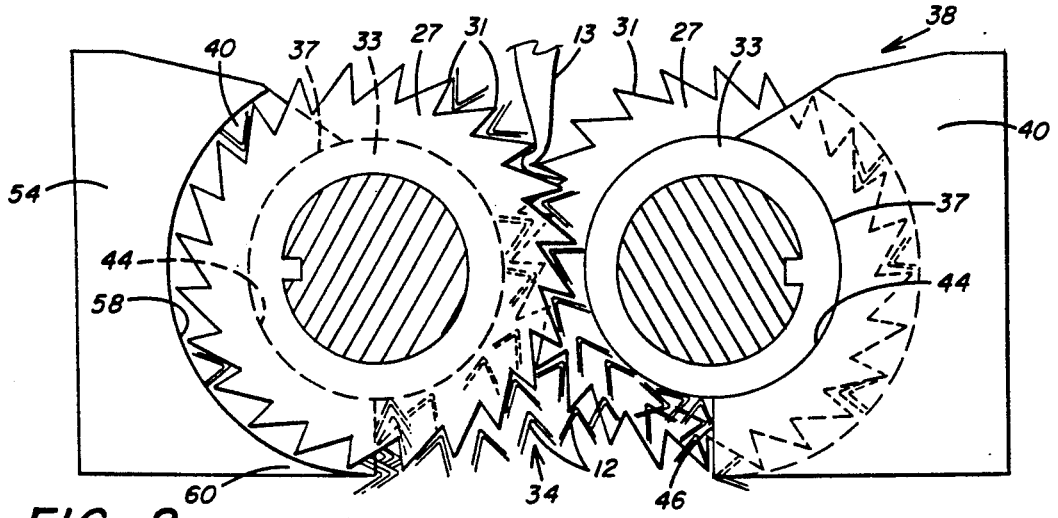
FIG. 2 PRIOR ART
FIG. 2 is a side view of a prior art comber configuration including the preferred cutting wheels.
Figure 3:
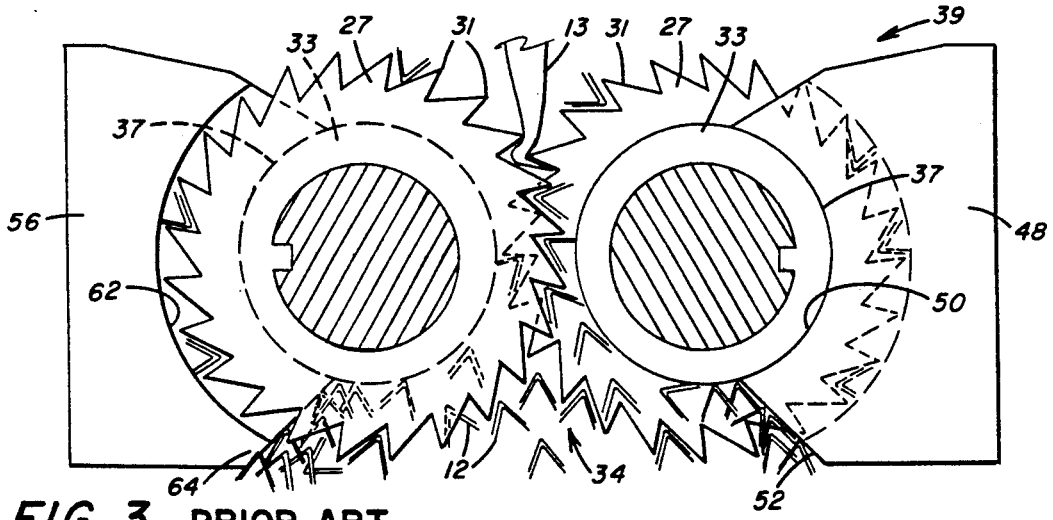
FIG. 3 PRIOR ART
FIG. 3 is a side view of another prior art comber configuration including the preferred cutting wheels.

As respectively seen in FIGS. 2 and 3, two such prior art combing configurations 38,39 have been employed to "comb" or "strip" the small pieces 12 from a cylindrical outer surface 37 of each rotating spacer 33 and the circumferential area of each cutting wheel 27. The configuration 38 of FIG. 2 includes a spacer comber section 40 at the side of the shafts remote from the cutting area 34. The spacer comber section 40 has a cylindrical inner surface 44 aligned with and closely disposed about the cylindrical outer surface 37 of the rotating spacer 33. Significantly, a lower end of the spacer comber section 40 includes a flat, vertical surface 46 with a similar alignment as the surface at the lower end of the combers employed in the machine of U.S. Pat. No. 4,923,126. The general arrangement employed in the prior art spacer comber section 40 shown in FIG. 2 is similar to the spacer combers employed in several cutting or shredding machines in the patents discussed hereinabove.

For example, German Auslegeshrift No. 1,291,606 includes a vertically disposed combing element which is very near the cutting area and, therefore, would have a similar effect as did the fixed comber of U.S. Pat. No. 4,923,126. On the other hand, the spacer comber section 40 of the prior art configuration 38 is similar to the spacer comber configurations shown in French Patent No. 45,173 and at one of the cutting wheel arrays of Japanese Patent No. 55-136597. More specifically, the surfaces at the lower end of the spacer comber configurations are generally aligned with the central axes of the cutting shafts to provide generally vertical surfaces for the impingement of the small pieces thereon. As seen in FIG. 2, although the surface 46 is located generally away from the cutting area 34, it has been found that the flat planar surface 46 still results in an undesirable collection of the small pieces 12 thereon. Continued collection at the surface 46, while not specifically preventing proper cutting in the cutting machine, clearly complicates its extended operation and could eventually reduce the overall effectiveness of the cutting machine 10.

As seen in FIG. 3, another prior art combing configuration 39 includes a spacer comber section 48 which again includes a cylindrical inner surface 50 which closely encircles the cylindrical outer surface 37 of the spacer 33. However, the lower end of the spacer comber section 48 includes a flat planar surface 52 which is inclined away from the cutting area 34. This surface 52 is similar to that found in U.S. Pat. No. 3,961,935; British Patent No. 1,558,423; German Offenlegungsschrift Nos. 2,526,650 and 2,723,281; and at one of the cutting wheel arrays of Japanese Patent No. 55-136597. From these prior art spacer combers and the general concept of the planar surface being inclined away from the cutting area 34, one might assume that no collection of small pieces 12 would occur thereon. However, as seen in FIG. 3, it has been found that the small pieces 12 having soft drink material deposited thereon still tend to collect in a manner which could be detrimental to the overall operation of the cutting machine 10.

The other prior art devices discussed hereinabove do not have a vertical or inclined surface below the cutting area. Instead, the devices of German Patenschrift No. 249,359; German Offenlegungsschrift Nos. 3,231,341 and 3,313,231; U.S. Pat. No. 4,068,805; and Japanese Patent No. 63-232860 include configurations in which a small comber section between the cutting wheels is confined to a small limited area to the rear of the cutting shaft. Such a configuration might prevent the undesired transportation of small pieces around the shaft on the cylindrical outer surface of the spacer but would not prevent undesired collection in other regions generally remote from the cutting area at the backside of the spacers.

Consequently, it can be seen that the spacer comber sections of the prior art configurations shown in FIGS. 2 and 3, and in the various patents discussed hereinabove, do not provide an appropriate and reliable means for preventing the collection of the small pieces within the cutting machine in the area between the cutting wheels.

However, there is also significant concern regarding the collection of such small pieces of material in the area on the backside of the cutting wheels. The cutting machine disclosed in U.S. Pat. No. 4,923,126 included no combing or other such device to prevent the collection of small pieces in the areas aligned with the cutting wheels themselves. As mentioned above, several prior art configurations do include cutting wheel comber sections which are aligned with the region of the cutting wheels remote from the cutting section. U.S. Pat. No. 4,068,805 and Japanese Patent No. 63-232860 include configurations which are only partially disposed at the rear of the cutting wheels and, therefore, would not completely eliminate the collection of small pieces at the side of the shaft remote from the cutting area. On the other hand, French Patent No. 45,173 and Japanese Patent No. 55-135597 have cutting wheel comber sections which are closely aligned with the apexes of the cutting teeth and would therefore appear to prevent the collection of small pieces at the backside of the cutting wheels.

However, it should be noted that the cutting wheels have a plurality of cutting teeth at the outer edge thereof. The cutting wheel comber section cannot extend into the area between the teeth. As a result, any configuration which closely encircles the cutting wheel may prevent the collection of small pieces at the outer surface but would also prevent the removal of any pieces located between the cutting wheel teeth. Undesired retention of the small pieces between the cutting wheel teeth could clearly affect the ability of these teeth to provide the desired cuts when the teeth are rotated to the cutting area.

The prior art combing configuration 38 of FIG. 2 and the prior art combing configuration 39 of FIG. 3 respectively include cutting wheel comber sections 54,56. The cutting wheel comber section 54 of FIG. 2 includes an interior cylindrical surface 58 which closely encircles cutting wheel 27 at the apexes of the cutting teeth 31.

As seen, the small pieces 12 can collect at the apexes of the cutting teeth 31 but are not prevented from collecting between the cutting teeth 31. In fact, as indicated above, once the small pieces 12 are located between the cutting teeth 31 and begin to pass along the interior cylindrical surface 58, the interior cylindrical surface 58 prevents the dislodgement or removal of small pieces 12 from between the teeth 31. As a result, the pieces 12 may be returned to the cutting area 34 to interfere with effective cutting of the container. The lower end 60 of the cutting wheel comber section 54 terminates at a point which, at first impression, would appear to "scrape" small pieces 12 from the apexes of the cutting teeth 31. However, as will be seen, the pointed shape at the lower end 60 of the cutting wheel comber section 54 tends to collect small pieces 12 thereon.

The cutting wheel comber section 56 of FIG. 3 also includes a interior cylindrical surface 62 to closely encircle the apexes of the cutting teeth 31. However, the lower end 64 of the cutting wheel comber section 56 has a planar surface which is generally perpendicular to the interior cylindrical surface 62. Being located further from the center axis of the shaft to be more remote from the cutting area 34, one might think that the small pieces 12 would not tend to collect thereon. However, it has been found that the small pieces 12 which are not entrapped between the cutting wheel teeth 31 tend to collect on the planar surface at the lower end 64 in the same manner as generally discussed for the spacer comber sections of the prior art.

Clearly, from the discussion of the embodiments shown in FIGS. 2 and 3 and those disclosed in the patents mentioned hereinabove, none of the prior art combing means will insure that the small pieces, which are produced by the cutting of plastic bottles and metal cans in the soft drink industry, will not collect below the cutting area or in the region of the shaft remote from the cutting area.

It is significant that both the combing configurations 38, 39, although not shown in sections in FIGS. 2 and 3, are provided as integrally formed elements like each of the prior art devices in the patents which included combing at both the annular spacer rings and the cutting wheels. Such an integral construction will prevent the collection of small pieces 12 in most of the region at the remote side of the shafts. However, the actual shape and form provided in the prior art configuration of FIGS. 2 and 3 will not effectively prevent other forms of collection of the small pieces 12 which can be detrimental to the cutting of the containers throughout the life of the machine.

As seen in FIGS. 1 and 4, the preferred cutting machine 10 includes the array of cutting wheels 26,28 with an identical tooth design as the prior art combing configurations of FIGS. 2 and 3. It is physically impossible for the cutting wheel comber sections to extend into the area between the cutting teeth. A configuration which closely, encircles the cutting wheel may prevent some collection of small pieces thereon but would also prevent the removal of any pieces located between the cutting teeth. Undesired retention of the small pieces between the cutting wheel teeth could clearly affect the ability of the teeth to provide the desired cuts when rotated to the cutting area of the cutting machine.

However, the preferred cutting machine 10 employs separate spacer combers 80 and cutting wheel combers 90 including various features of the invention to eliminated many of the problems found in the prior art configurations.

Specifically, the spacer combers 80 are mounted on a pair of rods 42 to include cylindrical inner surfaces 82 aligned with the cylindrical outer surfaces 36 of the annular spacers 32. The radial space between the outer surface 36 and the inner surface 82 is less than the minimum thickness of the material being cut in order to prevent any pieces from becoming lodged between the two cylindrical surfaces.

The lower end 84 of the spacer comber 80 does not include a planar surface as found in the prior art configurations discussed hereinabove. Instead, the lower end 84 includes a curved or rounded surface 86 which generally starts below the center axis 18,20 and curves away from the cutting area 34. It has been found that the small pieces 12, which have small planar surfaces, are less capable of sticking to or collecting on the curved or rounded surfaces 86. Accordingly, the spacer combers 80 effectively "comb" or "scrape" small pieces 12 from the cylindrical outer surfaces 36 of the annular spacers 32. As a result, the small pieces 12 will not collect between the cutting wheels 26,28 in an area remote from the cutting area 34 or on the combing surface below the shafts 14,16 near the cutting area 34 as occurred in the prior art configurations discussed hereinabove.

The preferred machine 10 includes the cutting wheel combers 90 which are also mounted on the rods 42. Each cutting wheel comber 90 includes an interior concave surface 92 adjacent to and partially surrounding the cutting wheel 26,28. The concave surface 92 terminates at a lower end 96 at a convex rounded portion 94 of the cutting wheel comber 90. The concave surface 92 is spaced from the circular path of the apexes of the cutting teeth 30. An intermediate region 98 of the concave surface 92 is generally located above the central axis 18,20 of each of the shafts 14,16. A first predetermined distance D1 between the concave surface 92 and the cutting teeth 30 thereby at the intermediate region 98 is sufficiently small to restrict passage of the small pieces therebetween. However, the first predetermined distance D1 is sufficiently large to allow some small pieces, depending on their orientation with respect to the teeth, to pass by the intermediate region 98 if they be retained on the apexes of the teeth 30. More significantly, the distance D1 at 98 is sufficiently large to allow small pieces 12 located between the cutting teeth 30 to at least partially escape from between the cutting teeth 30 by centrifugal force created during the rotation of the cutting wheels 26,28.

The lower end 96 of the concave surface 92 adjacent the convex rounded portion 94 is at a second predetermined distance D2 from the apexes of the cutting teeth 30 rotating thereby. The second predetermined distance D2 is larger than the first predetermined distance D1. Consequently, as the small pieces 12 are brought into alignment with the concave surface 92, there is sufficient space at the lower end 96 for the centrifugal forces created on the small pieces 12 by the rotation of the cutting wheels 26,28 to dislodge them from between the cutting teeth 30. In other words, most of the small pieces 12 which might collect between or on the cutting teeth 30 are capable of being dislodged and being directed toward the concave surface 92. The smooth concave surface 92 with a diverging space from the intermediate region 98 to the lower, convex rounded portion 94 allows most of the small pieces 12 to pass by gravity to an area below the cutting machine 10.

Any pieces tending to collect at the teeth 30 may be dislodged at any point along the concave surface 92. The upper end 100 of the concave surface 92 is at a third predetermined distance D3 from the cutting wheel 26,28 which is larger than the first predetermined distance D1 at the intermediate region 98. Those few pieces which are passed beyond the intermediate region 98 are capable of being cleaned or bumped out at the upper region 100 by the rotation of the cutting wheels 26,28. However, as indicated, most of the small pieces 12 are dislodged prior to their being transported to the intermediate region 98 and therefore fall through the widening space past the rounded portion 94 to be discharged below the machine 10.

The convex rounded portion 94 is preferred rather than being a pointed area, such as at 60 in the combing configuration 38, or planar, such as at 64 of the combing configuration 39, in order to eliminate the collection of any small pieces thereon. Small pieces 12 may impinge upon the convex rounded portion 94 but will not collect thereon as occurs with the cutting wheel comber sections of the prior art devices discussed hereinabove.

The preferred machine 10 includes spacer combers 80 and cutting wheel combers 90 which prevent any undesired collection of the small pieces 12 at the backside of the shafts 14,16 remote from the cutting area 34. Further, the shape and form of the preferred spacer combers 80 and cutting wheel combers 90 will prevent the collection of the small pieces 12 on the surfaces thereof as occurs in the prior art configurations.

As mentioned above, some of the prior art configurations providing combing at the spacers and the cutting wheels disclosed in the various patents and shown in FIGS. 2 and 3 were integrally formed. The preferred cutting machine 10 includes separately formed spacer combers 80 and cutting wheel combers 90 mounted on the support rods 42. While formation of individual combers 80,90 may appear to be more complicated, the overall configuration is desirable for use in the cutting machine 10 which is employed to cut the containers found in the soft drink industry. As clearly established hereinabove, the corrosive nature of the soft drink liquid and the overall difficulty of producing such small pieces of the container eventually causes wear to the cutting teeth 30 of the cutting wheels 26,28. When the machine 10 must be overhauled, the cutting wheels 26, 28 are removed from the machine 10 in order to grind the backside of each tooth 30 to sharpen the apexes of the teeth 30. When each apex is sharp, the machine 10 can effectively produce the transverse cuts. However, there is also wear at the side edges of the cutting teeth 30 which could reduce the ability to produce the longitudinal cuts which complete the formation of the small pieces 12.

The preferred machine 10, as generally shown at the upper portion of FIG. 1 and specifically used to cut metal cans, includes ten cutting wheels 26 and nine cutting wheels 28. Each of the cutting shafts 14,16 has an effective length L of about 5.625 inches in the cutting area. To improve the cutting at the side edges of the cutting teeth 30, the machine is disassembled and each of the cutting wheels 26,28 is surface ground to reduce its overall thickness to form narrower cutting wheels 26*n*,28*n*. The amount of surface grinding is sufficient to reduce the overall thickness of the array so that an additional cutting wheel 26*n* and an additional cutting wheel 28*n* can be installed in the machine 10 as seen in the lower portion of FIG. 2. Obviously, this also requires surface grinding of the spacers 32 to form narrower spacers 32*n* and an additional spacer 32*n* is installed on each shaft 14,16 in order to maintain the overall length of the machine 10.

When reducing the thickness of the cutting wheels 26,28 and the spacers 32 to overhaul the machine 10, the original thickness of each of the combers 80,90 must also be reduced in order to provide proper alignment of narrower combers 80*n*,90*n* with the surface ground cutting wheels 26*n*,28*n* and spacers 32*n*. Any integrally formed combing configuration, such as those found in the prior art devices discussed hereinabove, would no longer be capable of being employed to properly comb the new cutting wheel array. With the preferred configuration of the present invention, the inclusion of an additional set of combers 80*n*,90*n* for each of the shafts 14,16 allows the machine 10 to be overhauled in a manner which was not capable of being accomplished with the prior art comber configurations discussed above.

It should be noted that the overall effective length and the spacing throughout the machine 10 is quite critical. In other words, the preferred machine 10 includes a firm axial alignment and positioning of the cutting wheels 26 and spacers 32 on the shafts 14 and a similar firm array of cutting wheels 28 and spacers 32 on the shaft 16. Any axial movement of the cutting wheels 26,28 which might cause contact between the surfaces thereof is undesirable. Similarly, any undesired axial movement of the combers 80,90 which might allow contact between the comber spacer combers 80 and the cutting wheels 26,28 is also undesirable. Undesired contact by any of these elements could harm the side edges of the cutting teeth and significantly interfere with the ability of the cutting wheels to produce the required longitudinal cut for the formation of the small pieces. Accordingly, the general axial spacing of the combers 80,90 is such that the cutting wheel combers 90 have a slightly greater thickness than do the cutting wheels 26,28. To provide the overall axial spacing, the spacer combers 80 have a slightly smaller thickness than the spacers 32. To provide the overall length required for the machine 10, the array of cutting wheels 26 on the shaft 14 includes slightly thinner cutting wheel combers 91 in each end thereof in order to provide the desired spacing of the overall machine 10. The end cutting wheel combers 91 are identical to the cutting wheel combers 90 except for the thickness thereof in order to provide this desired effective length in the cutting area. Obviously, when the machine 10 is overhauled, the thinner end cutting wheel combers 91 must also be surface ground to provide narrower end cutting wheel combers 91*n* for positioning at the ends of the shaft 14.

Having basically disclosed the overall operation of the preferred machine 10, it is appropriate to provide specific dimensions of various components therein in order to better understand the function of the machine during the cutting of the containers. As mentioned above, the effective length L of the cutting shafts for the machine 10 which is particularly adapted for cutting metal cans is about 5.625 inches. However, for the cutting of large plastic bottles, the effective length L of the machine 10 is about 8 inches. Clearly, additional cutting wheels, annular spacers, spacer combers, and cutting wheel combers are added to longer shafts in the machine in order to provide the longer effective length L for the cutting of the plastic bottles.

The preferred shafts have a maximum diameter of about 2.40 inches. There are 23 matching splines on each of the cutting shafts and at the interior of each of the cutting wheels and annular spacers thereon. The distance between the central axes of the cutting shafts is about 4 inches. With the cutting wheels having a maximum diameter of about 4.875 inches, the cutting wheels tend to have an overlapping distance of about 0.875 inches in the cutting area therebetween. The preferred cutting wheels have 24 identical teeth thereon.

Each of the preferred cutting wheels, as initially installed in the machine, has a thickness of about 0.2945 inches. Accordingly, the small pieces formed thereby tend to have a width of about 0.2945 inches and a length of about 0.625 inches. The small pieces of the metal cans and of the plastic bottles respectively have a thickness of about 0.010 inches and about 0.020 inches. The small pieces tend to have a characteristic fold in the middle thereof separating planar portions as generally shown in the figures. The preferred annular spacers have a thickness of about 0.296 inches when initially installed to properly separate the cutting wheels. The spacer combers, being intentionally narrower in order to prevent contact with the cutting wheels, have an initial thickness of about 0.245 inches. The cutting wheel combers which, as indicated above, are thicker, have an initial thickness of about 0.344 inches. The first predetermined distance is about 0.08 to about 0.10 inches. The second predetermined distance is about 0.30 to about 0.32 inches. The third predetermined distance is about 0.11 to about 0.14 inches.

Although not shown in FIG. 1, the preferred motor and reduction gear configuration include a electric motor rated at about 2 HP with the reduction gear having a speed reduction of about 25 to 1.

From the disclosure of the prior art machine shown in U.S. Pat. No. 4,923,126, it should be clear that the preferred machine could be configured to include some means for driving a feed paddle configuration above the cutting machine. While the prior art machine included a sprocket and chain mounting for each shaft at the end of the machine opposite from that including the drive gears, details regarding such a feeding means have been omitted from the drawing in order to better disclose the cutting machine itself which is the subject of the present invention. Various alternative configurations well-known in the machine art could be utilized for providing a means for feeding the containers to the machine to be cut thereby and are not considered to be a part of the invention as claimed.

Figure 5:
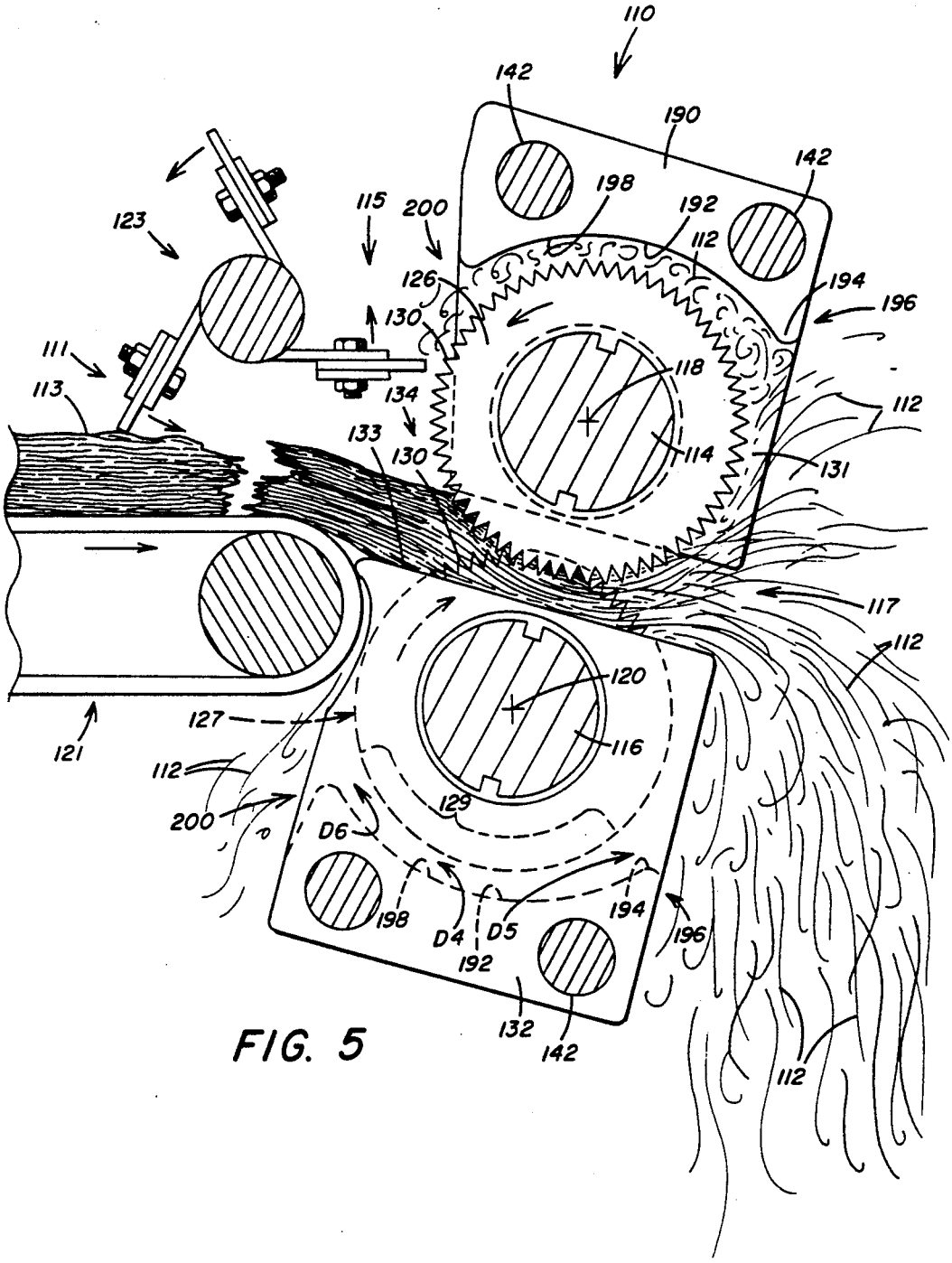
FIG. 5 is a sectional side view of another improved machine for cutting sheet material into at least narrow strips of the material including various features of the invention.

As seen in FIG. 5, a similar improved configuration for the cutting wheel combers of the machine 10 shown in FIGS. 1 and 4 can also be employed in an improved paper shredding machines 110 to insure the continued, reliable operation thereof. The paper shredding machine 110 typically includes a feed configuration 111 at the feed side 115 of the machine 110. The feed configuration 111 includes belt means 121 and a rotating crusher paddle means 123 for advancing a plurality of paper sheet material 113 in a generally stacked form toward the cutting area 134 of the paper shredding machine 110.

The paper shredding machine 110 includes a pair of parallel cutting shafts 114,116 mounted for rotation about their central axes 118,120 in opposite directions. The cutting shaft 116 is coupled to a motor and reduction gear configuration (not shown) to cause rotation in the clockwise direction as seen in FIG. 5. The shaft 116 includes a gear (not shown) which is engaged with a gear (not shown) on shaft 114 in order to produce the opposite rotation of the shafts.

Each shaft 114,116 includes axially extending groove means for the receipt of matching keys at a center opening in each of a plurality of cutting wheels 126,128. The cutting wheels 126,128 are identical and include a plurality of cutting teeth 130 thereon with the cutting teeth 130 moving along a circular path 127. While some cutting wheel configurations may not employ such cutting teeth 130, the cutting wheel teeth 130 in the preferred paper shredding machine 110 facilitates the drawing of the paper material 113 into a cutting region 134 between the cutting shafts 114,116. The cutting wheels 126,128 are capable of producing at least a plurality of narrow strips 112 which, after formation, tend to be discharged at the discharge side 117 of the machine 110.

While the overlapping cutting wheels 126,128 tend to define the cutting region 134, there is also included a plurality of spacer-combers 131 respectively between adjacent cutting wheels 126 on the shaft 114 and a plurality of spacer-combers 132 respectively between adjacent cutting wheels 128 on the shaft 116. The spacer-combers 131,132 are mounted on support rods 142 to be maintained in general alignment with the cutting wheels 128,126 on the other shaft 116,114. Each of the spacer-combers 131,132 includes a surface 133 which is generally aligned with the cutting wheel 128,126 on the other shaft 116,114 to direct the sheet material 113 through the cutting area 134 for the proper cutting of the sheet material 113 into a plurality of the narrow strips 112.

As thus described, the shredding machine 110 includes features which are generally incorporated in many types of paper shredding machines. The shredding machine 110 includes the "fixed" spacer-combers 131, 132 rather than the annular spacer employed in the machine 10 because it has been found that the "fixed" surfaces 133 will not prevent or retard the proper movement of paper through the cutting area 134. With such machines being employed to cut paper material, it is not uncommon for them to include no means for combing the material from the remote side of the cutting wheels themselves. Consequently, after the material is cut into a plurality of narrow strips, the greatest number of such strips are freely discharged from the discharge side of the machine. However, it is also not uncommon for a small percentage of the strips to remain in contact with and to be transmitted with the rotating cutting wheels to collect between some form of spacer-comber configuration in the other prior devices at the backside of the cutting wheels remote from the cutting area.

Generally, one might assume that the collection of strips of paper in such an area would not be determental to the operation of the shredding machine. However, as the strips of paper tend to significantly build up in this region, they become quite jammed therein and extremely difficult to remove should any repairs or adjustments be needed to the cutting components of the shredding machine. Additionally, as a significant number of strips of paper are being collected, the "rough" surfaces formed by the compacted collection of narrow strips in the spaces between the spacer-comber configuration tend to grip or retain other strips of material as they are being formed by the cutting wheels to further add to the collection.

On the other hand, one might assume that the very close concave surface employed in many of the prior art cutting wheel combers discussed hereinabove would be appropriate to prevent the undesired collection of any strips of paper cut by such a paper shredding machine. By closely encircling the remote region of the cutting wheels with such cutting wheel combers, it would appear that no paper material could be transmitted or passed to the backside of the cutting wheels. However, it should be recognized that, with very thin paper, the tolerances between the concave surface of a cutting wheel comber and the circular path of the teeth on the cutting wheel would have to be extremely small to prevent any paper from being passed along with the teeth around to the remote side of the cutting wheels. If any paper or parts of the paper can be carried along the outer surface of the cutting wheels to the remote side of the cutting wheels, it could collect, become compacted, and interfere with the effective operation of the shredding machine.

Consequently, the preferred improved shredding machine 110 includes a plurality of cutting wheel combers 190 which are mounted on the support rods 142 between the adjacent spacer-combers 131,132. Each cutting wheel comber 190 includes a concave surface 192 adjacent to and partially surrounding its respective cutting wheel 126,128. The concave surface 192 terminates, at a discharge end 196 toward the discharge side 117 of the machine 110, at a convex rounded portion 194 of the cutting wheel comber 190. The concave surface 192 is radially spaced from the circular path 127 of the apexes of the cutting teeth 130. The concave surface 192 extends from the discharge end 196 to the feed end 200 which is generally located at the feed side 115 of the machine 110 along an arcuate portion 129 of the circular path 127.

As seen in FIG. 5, an intermediate region 198 of the concave surface 192 is generally located relative to the central axes 118,120 of each of the shafts 114,116 toward the feed side 115 of the machine 110. A first predetermined radial distance D4 at the intermediate region 198 between the concave surface 192 and the cutting teeth 130 is sufficiently large to allow the passage of some of the strips 112 of material thereby. Nevertheless, the first predetermined D4, in the machine 110 of FIG. 5, is the shortest distance between the concave surface 192 and the arcuate portion 129 of the circular path 127 of the cutting teeth 130 as they progress along the concave surface 192 during the rotation of the cutting wheels 126,128. In other words, as any strips 112 or portions thereof pass around the cutting wheels 126,128, they would tend to be more restricted in the area of the intermediate region 198.

The discharge end 196 of the concave surface 192, adjacent the convex rounded portion 194, is at a second predetermined radial distance D5 from the arcuate portion 129 of the circular path 127 of the cutting teeth 130 rotating thereby. The second predetermined radial distance D5 is larger than the first predetermined radial distance D4. Consequently, as those narrow strips 112, which are not properly discharged at the discharge side 117 of the machine 110, are generally brought into alignment with the concave surface 192, there is sufficient space at the discharge end 196 for the narrow strips 112 to be lightly collected and partially compacted therein. However, with the continuing rotation of the cutting wheels 126,128, the strips 112 are caused to be generally advanced along the concave surface 190 by the cutting teeth 130.

As the narrow strips 112 are advanced toward the intermediate region 198 between the cutting teeth 130 and the concave surface 192, the diverging distance therebetween will tend to insure that the teeth 130 continue to act upon the strips 112 temporarily collected at the remote side of the cutting region 134. As the strips 112 temporarily collected between the teeth 130 and concave surface 192 pass by the intermediate region 198, they are advanced toward the feed end 200 of the concave surface 192 which is generally located at the feed side 115 of the machine 110. The feed end 200 of the concave surface 192 is at a third predetermined radial distance D6 from the cutting wheels 126,128 which radial distance D6 is larger than the first predetermined radial distance D4 at the intermediate region 198. Consequently, as the plurality of strips 112 are advanced beyond the intermediate region 198, the restricting, confining pressure thereon would be relieved so that the strips 12 would be cleaned or bumped out of the feed end 200 by the continuing rotation of the cutting wheels 126,128.

The convex rounded portion 194 is preferred rather than being pointed, such as at 60 in the prior art combing configuration 54 of FIG. 2, or planar, such as at 64 of the prior art combing configuration 56 of FIG. 3, in order to eliminate the collection of the strips 12 thereon. The strips 112 might partially bend or form around the convex rounded portion 194 but would not tend to be grabbed by or collected thereon as occurs with some of the cutting wheel comber sections of the prior art devices discussed hereinabove.

Accordingly, the preferred cutting wheel combers 190 include the preferred concave surface 192 which tends to allow a temporary collection of strips 112 in the region remote from the cutting area 134 but, by narrowing toward the intermediate region 198, insures the continuing action of the cutting teeth 130 thereon. As the cutting teeth 130 continue to rotate, the enlarging radial distance between the concave surface 192 and the arcuate portion 129 of the circular path 127 of the cutting teeth 130 toward the feed end 200 allows for the proper dislodgement of the strips 112, which have been temporarily collected, toward the feed side 115 of the machine 110. The dislodged strips 112 may fall directly into a collecting area (not shown) or be drawn in with new paper material 113 for repassage through the cutting area 134 and eventual discharge from the discharge side 117 of the machine 110 into the collecting area below. Frankly, the operation of the preferred machine 110 does not require all of the strips 112 to be specifically directed to the collecting area but should insure that there is no extensive, compacted collection of the strips 112 in the region between the teeth 130 and the concave surface 192.

Accordingly, while there might be some temporary collection of the strips 112 in a remote region of the machine 110, the overall configuration provides a self-cleaning feature. One might wonder how such a self-cleaning feature would present an improvement over the configurations discussed hereinabove in which there are no cutting wheel combers or in which there are cutting wheel combers having a concave surface which is configured to very closely encircle the cutting teeth.

As mentioned, if there is no cutting wheel comber, the collection of the strips would be significant and result in a continuing, ever tightening collection of compacted strips at the backside of the cutting wheels. In fact, one might assume that once there is a sufficient quantity of strips collected at the backside of the cutting wheels, additional strips would not be capable of being collected thereat. However, with the continuously rotating cutting wheels and the movement of the cutting teeth thereon, the previously collected and compacted strips would tend to be repeatedly worn or torn away. The friction on the teeth would produce undesired heat and the cutting by the teeth would tend to dull the teeth by causing them to produce additional "work" which would not normally be needed to form the strips. Consequently, the uncontrolled collection of strips at the remote side of the cutting wheels can significantly interfere with the effective, reliable operation of such a shredding machine.

Similarly, if the concave surface closely encircles the cutting teeth, as in some of the prior art configurations, a lesser number of strips will be jammed between the teeth and the concave surface. However, the few strips which are collected in the smaller space will still generate heat on the teeth and tend to dull the teeth as they continuously act on the strips.

Additionally, it should be noted that the uncontrolled collection of strips at the remote side of the cutting wheels greatly complicates the repair and maintenance of such machines as the strips are rigidly compacted into the area of the machine between the spacer-combers.

The preferred shredding machine 110 has a width of about 16.2 inches and includes twenty-four cutting wheels 126 on the shaft 114 and twenty-five cutting wheels 128 on the shaft 116. Each of the cutting wheels 126, 128 has an outside diameter of about 4.25 inches with a width of about 0.33 inch. While the number and configuration of cutting teeth 130 can be varied, it is not uncommon for there to be more than 200 such cutting teeth 130 on the preferred cutting wheels 126, 128.

In the preferred machine 110, the first predetermined radial distance D4 is about 0.414 inch, the second predetermined radial distance D5 is about 0.65 inch and the third predetermined radial distance D6 is about 0.47 inch. Consequently, while the machine 110 has a similar configuration to that of machine 10 discussed hereinabove, the preferred first predetermined radial distance D4 when shredding paper is significantly larger than that employed for the cutting of small pieces of the plastic bottles and/or metal cans. The first predetermined radial distance D4 is preferrably between about 0.35 inch and about 0.5 inch. By comparing the first predetermined radial distance D4 with the second predetermined radial distance D5, it is clear that for the preferred machine 110 for shredding paper material, the second predetermined radial distance D5 would be at least about one and one-half times the first predetermined radial distance D4. Similarly, in order to provide an enlarging space to insure removal of the strips, the third predetermined radial distance D6 should be at least one and one-tenth times the first predetermined radial distance D4.

While the relative dimensions for the first, second, and third predetermined radial distances are different for the preferred machine 10 for cutting the thin wall material of disposable containers and the preferred machine 110 for shredding sheet paper material, both would be capable of temporarily receiving some pieces or strips at the backside of the cutting wheels while still including the capability of being self-cleaning to prevent their collection or retention at the backside of the cutting wheels. Clearly, depending on the type of material being cut and the type of teeth formed on the cutting wheels, the relative dimensions of the first, second, and third predetermined radial distances could be varied to provide the described self-cleaning features. In other words, although the relative dimensions may differ, the preferred cutting wheel comber configuration discussed hereinabove includes a reducing space between the teeth and the concave surface from the discharge end to the intermediate region and an increasing space between the teeth and the concave surface from the intermediate region to the feed end.

Despite the specific features included in the embodiments of the cutting machine 10 and the preferred paper shredding machine 110, it should be noted that the present invention includes a cutting wheel comber which has a concave surface that terminates at the discharge end of the comber at a convex rounded portion and extends along the arcuate portion of the circular path at a radial distance which varies from the discharge end to the feed end. While the machines 10 and 110 have the intermediate region slightly toward the feed end, it should be noted that an intermediate region toward or at the discharge end would still provide an overall widening configuration which would prevent the retention of the pieces or strips of material and would insure their removal toward the feed end.

From the description provided hereinabove, it should be clear that various alterations could be made to the preferred machine without departing from the scope of the invention as claimed.

What is claimed is:

1. An improved machine capable of cutting material into at least narrow strips of the material, the machine being of a type which includes a pair of parallel cutting shafts mounted for rotation about central axes thereof in opposite directions, each of the cutting shafts supporting a plurality of cutting wheels mounted for rotation therewith, each of the cutting wheels having peripheral cutting means defining a circular path of the cutting wheel during the rotation, each of the cutting wheels on one of the cutting shafts axially separating and extending between axially adjacent cutting wheels on the other of the cutting shafts, a spacer-comber means mounted to extend around the cutting shaft between each of the adjacent cutting wheels thereon and to provide a guiding surface aligned with the cutting wheel on the other of the cutting shafts, the cutting wheels being capable of cutting the material into the narrow strips when the material is fed from a feed side of the machine into a cutting area between the cutting shafts for discharge toward a discharge side of the machine, wherein said improvement comprises:

a cutting wheel comber fixedly mounted remote from the cutting area and aligned with each of the cutting wheels and disposed between the adjacent spacer-comber means of the cutting wheel;

said cutting wheel comber having a concave surface adjacent to, partially surrounding, and radially spaced from the circular path of the cutting wheel;

said concave surface of said cutting wheel comber terminating at a convex rounded portion of said cutting wheel comber at a discharge end of said cutting wheel comber located toward the discharge side of the machine;

said convex rounded portion having a convex surface;

said concave surface and said convex surface having a smooth transition therebetween; and said convex rounded portion being located toward the discharge side of the central axis and disposed therefrom toward a side which is remote from the cutting area.

2. An improved machine capable of cutting material into at least narrow strips of the material, the machine being of a type which includes a pair of parallel cutting shafts mounted for rotation about central axes thereof in opposite directions, each of the cutting shafts supporting a plurality of cutting wheels mounted for rotation therewith, each of the cutting wheels having peripheral cutting means defining a circular path of the cutting wheel during the rotation, each of the cutting wheels on one of the cutting shafts axially separating and extending between axially adjacent cutting wheels on the other of the cutting shafts, a spacer-comber means mounted to extend around the cutting shaft between each of the adjacent cutting wheels thereon and to provide a guiding surface aligned with the cutting wheel on the other of the cutting shafts, the cutting wheels being capable of cutting the material into the narrow strips when the material is fed from a feed side of the machine into a cutting area between the cutting shafts for discharge toward a discharge side of the machine, wherein said improvement comprises:

a cutting wheel comber fixedly mounted remote from the cutting area and aligned with each of the cutting wheels and disposed between the adjacent spacer-comber means of the cutting wheel;

said cutting wheel comber having a concave surface adjacent to, partially surrounding, and radially spaced from the circular path of the cutting wheel;

said concave surface of said cutting wheel comber terminating at a convex rounded portion of said cutting wheel comber at a discharge end of said cutting wheel comber located toward the discharge side of the machine;

said convex rounded portion being located toward the discharge side of the central axis and disposed therefrom toward a side which is remote from the cutting area;

said concave surface extending along an arcuate portion of the circular path of the cutting wheel from said discharge end toward a feed end of said concave surface which said feed end is located toward the feed side of the machine; and the arcuate portion of the circular path and said concave surface having a radial distance therebetween which varies along the arcuate portion from said discharge end of said concave surface to said feed end of said concave surface.

3. The improved machine according to claim 2, wherein said concave surface includes an intermediate region between said discharge end and said feed end, said intermediate region is located toward the feed side of the central axis, and said intermediate region is a first predetermined radial distance from the arcuate portion of the circular path of the cutting wheel for restricting passage of the narrow strips therebetween.

4. The improved machine according to claim 3, wherein said discharge end of said concave surface of said cutting wheel comber is at a second predetermined radial distance from the arcuate portion and said second predetermined radial distance is larger than said first predetermined radial distance.

5. The improved machine according to claim 4, wherein said feed end of said concave surface is at a third predetermined radial distance from the arcuate portion and said third predetermined radial distance is larger than said first predetermined radial distance.

6. The improved machine according to claim 5, wherein said first predetermined radial distance is between about 0.35 inch to about 0.50 inch when the material is sheet paper.

7. The improved machine according to claim 6, wherein said second predetermined radial distance is at least about one and one-half times said first predetermined distance.

8. The improved machine according to claim 5, wherein said first predetermined radial distance is between about 0.08 inch and about 0.10 inch when the material is the thin walls of disposable containers such as plastic bottles or metal cans.

9. The improved machine according to claim 8, wherein said second predetermined radial distance is at least about three times said first predetermined radial distance.

10. The improved machine according to claim 5, wherein said second predetermined radial distance is at least one and one-half times said first predetermined radial distance and said third predetermined radial distance is at least one and one-tenth times said first predetermined radial distance.

11. The improved machine according to claim 2, wherein said concave surface includes at least an intermediate region between said discharge end and said feed end, said intermediate region is a first predetermined radial distance from the arcuate portion of the circular path of the cutting wheel, said feed end of said concave surface is at a third predetermined radial distance from the arcuate portion, and said third predetermined radial distance is larger than said first predetermined radial distance.

* * * * *